US005812033A

United States Patent [19]

Chaki et al.

[11] Patent Number: 5,812,033

[45] Date of Patent: Sep. 22, 1998

[54] MICROWAVE INTEGRATED CIRCUIT

[75] Inventors: Shin Chaki; Yoshinobu Sasaki; Yoshihiro Tsukahara, all of Tokyo, Japan

[73] Assignee: Mitsubishi Denki Kabushiki Kaisha, Tokyo, Japan

[21] Appl. No.: 766,098

[22] Filed: Dec. 16, 1996

[30] Foreign Application Priority Data

Jun. 6, 1996 [JP] Japan ..... 8-144004

[51] Int. Cl.[6] ..... H01P 5/00

[52] U.S. Cl. ..... 333/33; 333/161

[58] Field of Search ..... 333/33, 116, 161

[56] References Cited

U.S. PATENT DOCUMENTS

| | | | |
|---|---|---|---|
| 4,356,462 | 10/1982 | Bowman | 333/161 X |
| 4,641,113 | 2/1987 | Ozawa | 333/161 |
| 5,065,117 | 11/1991 | Yoshimasu | 333/33 |
| 5,206,607 | 4/1993 | Shiga | 333/33 X |
| 5,455,545 | 10/1995 | Garcia | 333/116 X |
| 5,625,169 | 4/1997 | Tanaka | 333/116 X |

FOREIGN PATENT DOCUMENTS

| | | |
|---|---|---|
| 57-84149 | 5/1982 | Japan . |
| 6-21221 | 1/1994 | Japan . |
| 7-288315 | 10/1995 | Japan . |

OTHER PUBLICATIONS

Chaki et al., "A Miniaturized X–Band 4–Stage LNA Designed Using A Novel Layout Optimization Technique", 1996 IEEE MTT–S International Microwave Symposium Digest, vol. 3, Jun. 1996.

Chaki, Shin, et al. "A Design Method of an X–Band Miniaturized MMIC Amplifier Considering a Coupling between Lines." *IEICE Technical Report* 95.449 (1996), pp. 49–54.

*Primary Examiner*—Paul Gensler

*Attorney, Agent, or Firm*—Leydig, Voit & Mayer

[57] ABSTRACT

A microwave integrated circuit includes a matching circuit for electromagnetic analysis in designing the circuit. The matching circuit is a T-junction circuit comprising distributed constant lines. Miniaturization of the microwave integrated circuit is realized while reducing the time required for electromagnetic analysis and improving design precision by using meandered distributed constant lines.

10 Claims, 10 Drawing Sheets

MICROWAVE INTEGRATED CIRCUIT

FIELD OF THE INVENTION

The present invention relates to a microwave integrated circuit employing distributed constant lines for a matching circuit and, more particularly, to miniaturization of the microwave integrated circuit, reduction in time required for design of the circuit using electromagnetic (EM) analysis, and improvement of the design precision.

BACKGROUND OF THE INVENTION

FIG. 16 is a plan view illustrating a conventional microwave integrated circuit. This microwave integrated circuit is a double-stage amplifier comprising a chip substrate 1, two FETs 2, seven capacitors 3, and two via-holes 4. These FETs, capacitors, and via-holes are connected to each other in a matching circuit comprising distributed constant lines 5. In order to avoid that the circuit performance at the design frequency be significantly different from the practical circuit performance, the distributed constant lines 5 are sufficiently spaced apart from the FETs 2, the MIM capacitors 3, and the via-holes 4. The chip size is $2.1\times3.0$ mm$^2$.

Generally, when a microwave integrated circuit employing distributed constant lines for a matching circuit is miniaturized, constituent elements, such as transmission lines, MIM capacitors, and via-holes, are placed close to each other, whereby the elements adversely affect each other, resulting in an untolerable error between the initial design characteristics and the practical characteristics. Therefore, the circuit design must be performed considering the influences of the closely placed elements on the performance of the circuit.

That is, the characteristics of the microwave integrated circuit depend on the pattern layout very much. When the microwave integrated circuit is designed, the final circuit simulation is performed on the basis of the layout, and there are two methods of simulating the circuit. One is a method including representing the circuit by combinations of models stored in a circuit simulator and simulating the circuit. The other is a method including performing EM analysis for passive elements in the circuit and combining S parameters obtained by the EM analysis to learn the overall performance. In the EM analysis, circuit characteristics are learned by solving Maxwell's equations. For example, the method of moments is known as an EM analysis method.

These simulation methods are compared in respect of miniaturization of the microwave integrated circuit. In the former simulation method, since the kind or the precision of the models stored in the circuit simulator is restricted, it is difficult to perform a precise simulation. Further, in a pattern layout for this method, since circuit elements are arranged so that adjacent elements do not adversely affect each other, the chip size is relatively large. Therefore, this method is not suitable for miniaturization of the circuit.

On the other hand, in the latter simulation method, since the circuit is divided into a plurality of regions and EM analysis is performed for each region, the simulation is not restricted by models in a circuit simulator. Therefore, the latter method is superior for miniaturization of the circuit to the former method.

However, when the number of the regions into which the circuit is divided is decreased to widen each region subjected to the EM analysis, the time required for the EM analysis is increased. In addition, since the region subjected to the EM analysis is large, it is difficult to know how the pattern correction (optimization) should be performed for the layout pattern designed to realize the target performance, from the characteristics obtained by the EM analysis.

Furthermore, when the number of the regions is increased to narrow each region subjected to the EM analysis, influences between the respective regions cannot be considered, so that the performance at design is not obtained. As a result, a highly precise design is not realized.

SUMMARY OF THE INVENTION

An object of the present invention is to provide a microwave integrated circuit that can be miniaturized while reducing the design time and improving the design precision when the circuit design is performed by EM analysis.

Other objects and advantages of the invention will become apparent from the detailed description that follows. The detailed description and specific embodiments described are provided only for illustration since various additions and modifications within the scope of the invention will be apparent to those of skill in the art from the detailed description.

According to a first aspect of the present invention, a microwave integrated circuit includes a matching circuit serving as a unit region for electromagnetic analysis employed in designing the circuit, and the matching circuit is a T-junction circuit comprising distributed constant lines. Therefore, miniaturization of the microwave integrated circuit is realized while reducing the time required for the electromagnetic analysis and improving the design precision.

According to a second aspect of the present invention, in the above-mentioned microwave integrated circuit, the T-junction circuit comprises a single distributed constant line or two distributed constant lines which can be regarded as a T-shaped line.

According to a third aspect of the present invention, in the above-mentioned microwave integrated circuit, the T-junction circuit includes a distributed constant line, a portion of which is meandered. Therefore, unwanted influences of peripheral patterns on circuit characteristics are reduced, so that the circuit design is precisely and easily performed, and miniaturization of the circuit is realized.

According to a fourth aspect of the present invention, in the above-mentioned microwave integrated circuit, all the distributed constant lines constituting the T-junction circuit are meandered. Therefore, miniaturization of the circuit is realized.

According to a fifth aspect of the present invention, in the above-mentioned microwave integrated circuit, each distributed constant line has a length, a width, and a space between adjacent portions, which are set at integer multiples of a minimum width of the distributed constant line. Therefore, the time required for the electromagnetic analysis is reduced, and the precision of the analysis is improved.

According to a sixth aspect of the present invention, a microwave integrated circuit includes a matching circuit comprising two distributed constant lines adjacent to and parallel with each other, and at least one of the parallel distributed constant lines being meandered. Therefore, unwanted influences of peripheral patterns on circuit characteristics are reduced, so that a miniaturized circuit is precisely and easily designed.

According to a seventh aspect of the present invention, in the above-described microwave integrated circuit, the two parallel distributed constant lines are formed by bending a single distributed constant line into a shape of Roman letter U.

According to an eighth aspect of the present invention, in the above-described microwave integrated circuit, the two parallel distributed constant lines are formed by closely arranging two distributed constant lines.

According to a ninth aspect of the present invention, a microwave integrated circuit includes a matching circuit comprising a distributed constant line placed in the vicinity of an element on the circuit, said distributed constant line being meandered. Therefore, a miniaturized circuit is precisely and easily designed.

DETAILED DESCRIPTION OF THE PREFERRED EMBODIMENTS

Figure 1:
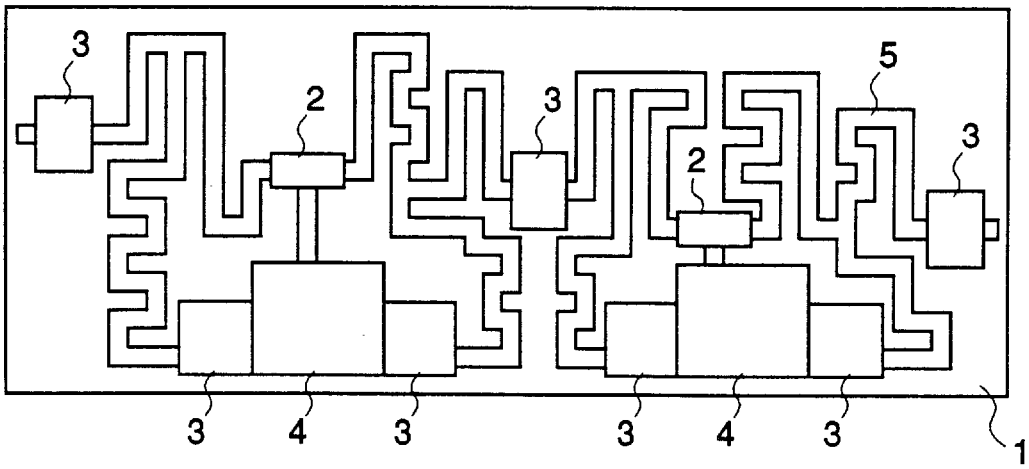
FIG. 1 is a plan view illustrating a microwave integrated circuit according to a first embodiment of the present invention.

FIG. 1 is a plan view illustrating a microwave integrated circuit in accordance with a first embodiment of the present invention. This microwave integrated circuit is a two-stage amplifier comprising two FETs 2, seven MIM capacitors 3, and two via-holes 4 which are integrated on a substrate 1. The FETs 2, the MIM capacitors 3, and the via-holes 4 are connected to each other by a matching circuit comprising a plurality of T-junction circuits of distributed constant lines 5.

Figure 2:
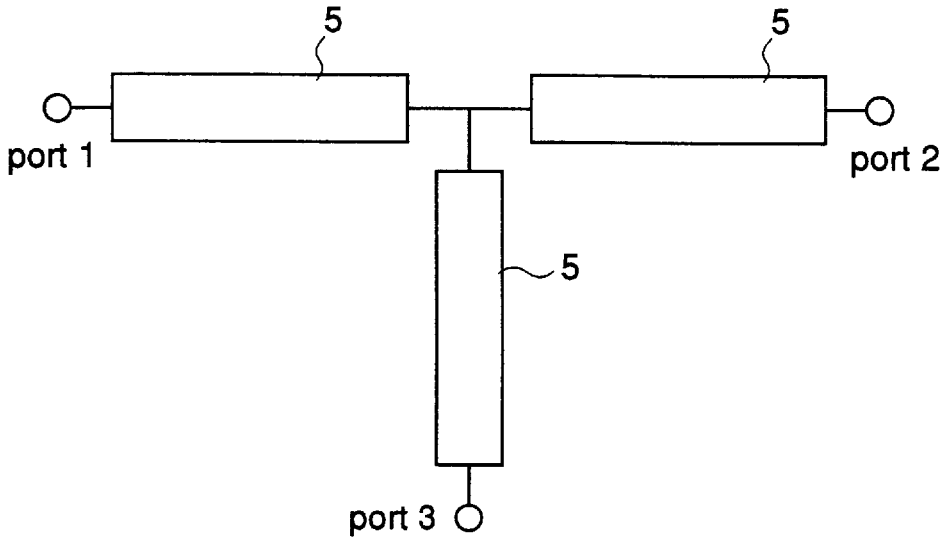
FIG. 2 is a schematic diagram illustrating a T-junction circuit included in the microwave integrated circuit according to the first embodiment of the invention.

FIG. 2 is a schematic diagram illustrating a T-junction circuit included in the microwave integrated circuit shown in FIG. 1. This T-junction circuit has three I/O ports 1, 2, and 3, and three distributed constant lines 5.

A description is given of the process of designing the microwave integrated circuit according to the first embodiment of the invention.

Figure 3:
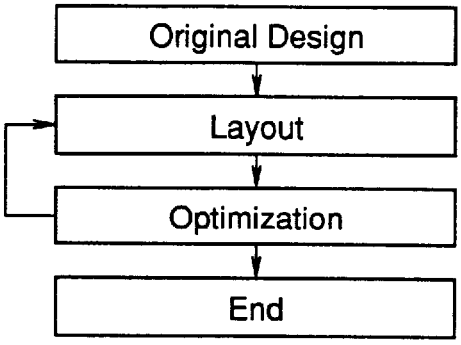
FIG. 3 is a flowchart for explaining a circuit design of the microwave integrated circuit according to the first embodiment of the invention.

FIG. 3 is a flowchart showing the design process when the matching circuit comprising the T-junction circuits is employed. As shown in FIG. 3, the design process comprises three steps, i.e., original design, layout, and optimization. First of all, original design to realize a target performance is performed. Next, pattern layout is performed on the basis of the original design, considering a reduction in the circuit size. After the pattern layout, EM analysis is performed for each transmission line. Then, the performance of the whole circuit is calculated using S parameters obtained by the EM analysis. The result of the calculation is compared with the result of the original design. When there is an unacceptable error, an effective length of each line is estimated by fitting. That is, an input length required for realizing the line length in the original design is obtained for each line, and layout is performed again, followed by EM analysis. The layout and the EM analysis are iterated until the target performance is achieved.

Although characteristics of the layout circuit are analyzed by EM analysis, characteristics of the distributed constant lines depend on the thickness and material of the substrate and on the width, length, thickness, and material of the lines. Usually, in designing a circuit, only the line width and the line length are used as parameters while other parameters are fixed. Further, to reduce the analysis time, the circuit must be divided into a plurality of regions. However, if the number of regions into which the circuit is divided is large, influences between the respective regions cannot be considered, so that the spaces between the regions must be increased to realize a highly precise design, resulting in an increase in the circuit size. On the other hand, if the number of the regions is small, the time required for the EM analysis is increased, and the pattern correction (optimization) from the characteristics obtained by the EM analysis to the target performance is difficult. So, when the number of regions into which the circuit is divided is decided, miniaturization of the circuit, design precision, and design time must be considered.

Figure 4:
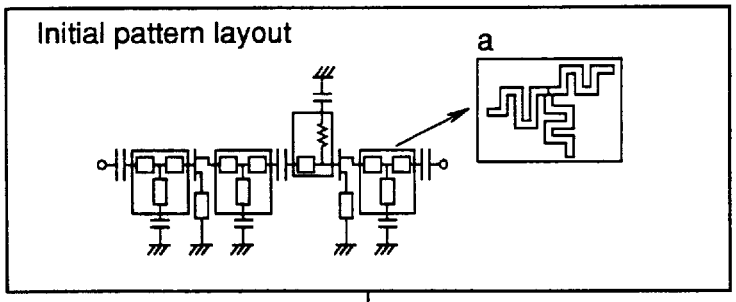
FIGS. 4(*a*)–4(*d*) are diagrams illustrating process steps in a design of the microwave integrated circuit according to the first embodiment of the invention.
Figure 4:
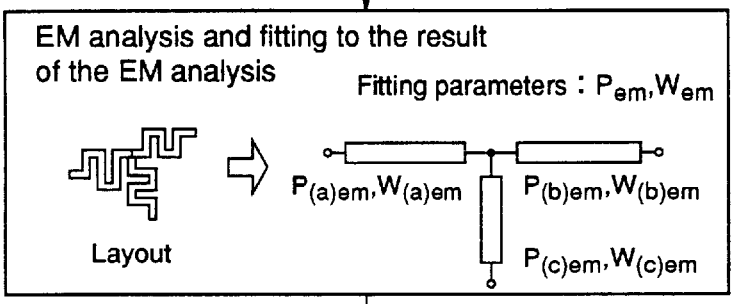
Figure 4:
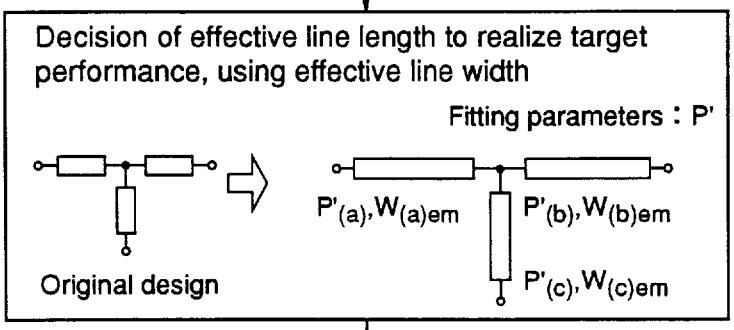
Figure 4:
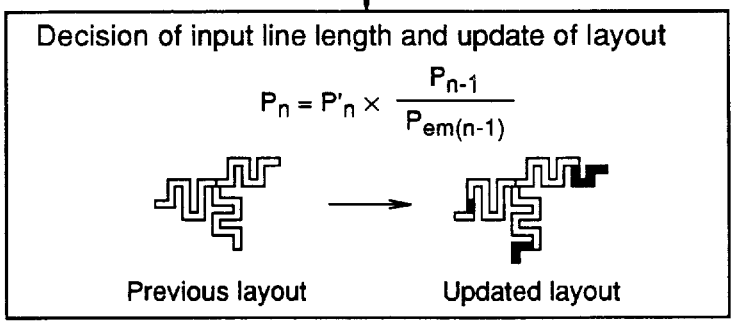

FIGS. 4(*a*)–4(*d*) show an example of a design process for the two-stage amplifier shown in FIG. 1.

Initially, as illustrated in FIG. 4(*a*), the pattern layout is performed on the basis of the original design. In FIG. 4(*a*), an equivalent circuit of the two-stage amplifier is illustrated. The layout is performed for a T-junction circuit in the matching circuit, considering a reduction in the circuit size (a in FIG. 4(*a*)). The RF characteristics obtained in the equivalent circuit are different from the RF characteristics of the layout pattern because of influences due to the line coupling and the close arrangement of the lines. Therefore, optimization of the layout must be performed to make the RF characteristics of the layout pattern approximately equal to the RF characteristics of the equivalent circuit.

In the step of FIG. 4(*b*), EM analysis and fitting to the result of the EM analysis are performed for each line in the layout pattern. In this step, an effective line width $W_{em}$ and an effective line length $P_{em}$ in the layout pattern are estimated.

In the step of FIG. 4(*c*), an effective line length to realize the target performance is decided using the effective line width. More specifically, using the effective line width $W_{em}$ obtained by the EM analysis and fitting to the result of the analysis shown in FIG. 4(*b*), a line length P' to realize the RF characteristics in the equivalent circuit of the original design shown in FIG. 4(*a*) is estimated.

Finally, in the step of FIG. 4(*d*), an input line length is decided and the layout is updated. More specifically, a line length $P_n$ (n: iteration number) to be input next is decided from the ratio of the line length obtained in the step of FIG. 4(*b*) to the line length obtained in the step of FIG. 4(*c*), i.e., $P'_n/P_{em(n-1)}$, and the line length $P_{n-1}$ of the present layout.

The above-described process steps are iterated until the characteristics of the whole circuit satisfy the target performance.

Figure 16:
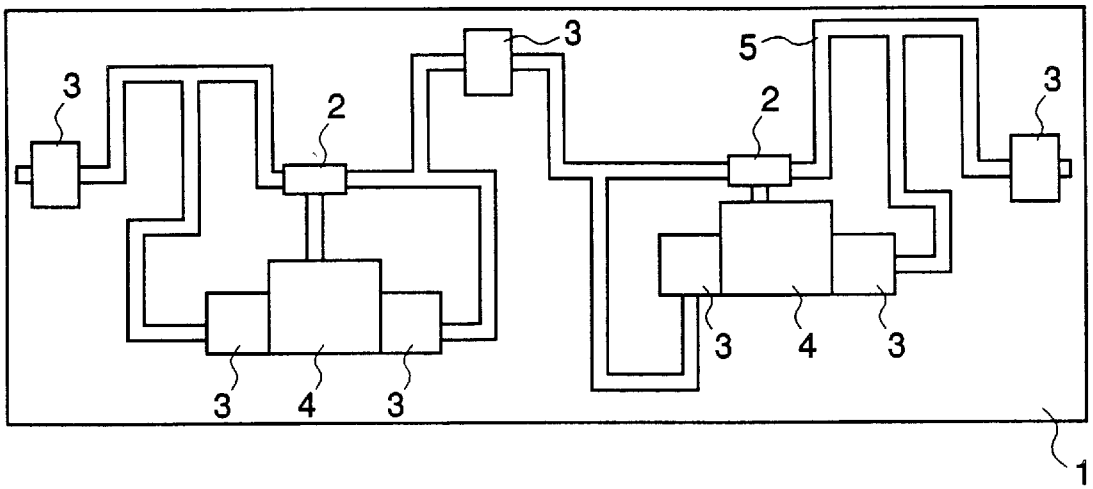
Fig.16 Prior Art
FIG. 16 is a plan view illustrating a microwave integrated circuit according to the prior art.

The microwave integrated circuit so produced has a chip size of 1.8×2.4 $mm^2$, that is, about a 30% reduction in the chip size is realized as compared with the conventional circuit shown in FIG. 16 having a chip size of 2.1×3.0 $mm^2$.

In the microwave integrated circuit according to the first embodiment of the invention, since the matching circuit comprises a plurality of T-junction circuits, when miniaturization of the microwave integrated circuit is considered, each T-junction circuit can be a unit region for EM analysis at the circuit design. Therefore, the time required for the design is reduced, and a highly precise design is realized considering the target performance for each T-junction circuit. As a result, the microwave integrated circuit is miniaturized with reduced design time and improved design precision.

Figure 5:
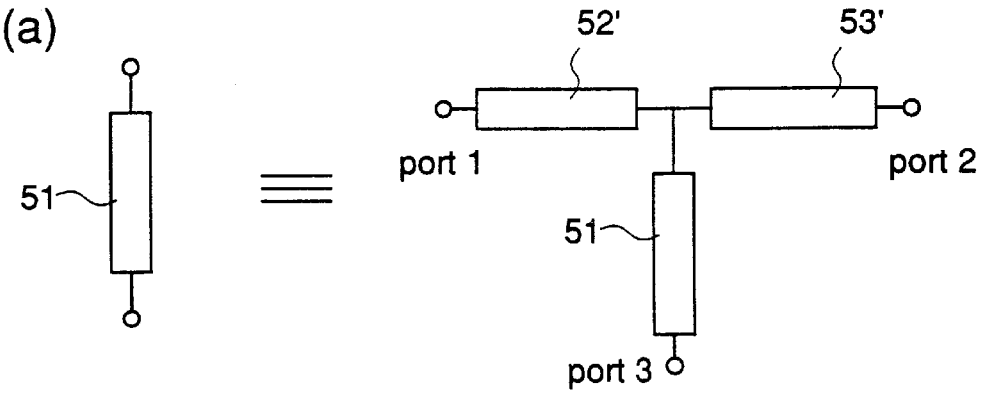
FIGS. 5(*a*)–5(*c*) are schematic diagrams illustrating patterns which can be regarded as T-junction circuits in the microwave integrated circuit according to the first embodiment of the invention.
Figure 5:
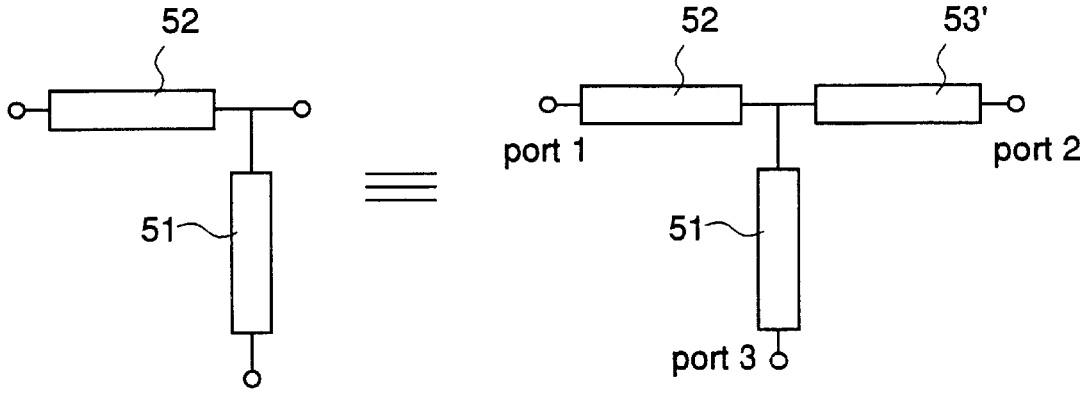
Figure 5:
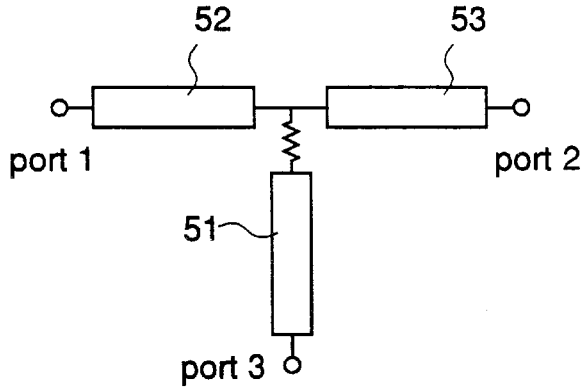

Although some unit regions for EM analysis do not have the shape of the T-junction circuit in which three lines are connected, these regions may be considered to have shapes corresponding to the T-junction circuit on design. FIGS. 5(*a*) and 5(*b*) show examples of patterns which can be considered as T-junction circuits, and FIG. 5(*c*) shows a T-junction circuit comprising lines 51, 52, and 53. A single line 51 shown in FIG. 5(*a*) can be regarded as a T-junction circuit when the lines 52 and 53 respectively connected to the port 1 and the port 2 of the T-junction circuit shown in FIG. 5(*c*) are regarded as lines of zero length. That is, in this case, the single line 51 is regarded as a T-junction circuit comprising the single line 51 and the zero-length lines 52' and 53' as shown in FIG. 5(*a*). Likewise, two lines 51 and 52 shown in FIG. 5(*b*) can be regarded as a T-junction circuit when the line 53 connected to the port 2 of the T-junction circuit shown in FIG. 5(*c*) is regarded as a line of zero length. That is, as shown in FIG. 5(*b*), the lines 51 and 52 are regarded as a T-junction circuit comprising these lines 51 and 52 and the zero-length line 53'.

[Embodiment 2]

Figure 6:
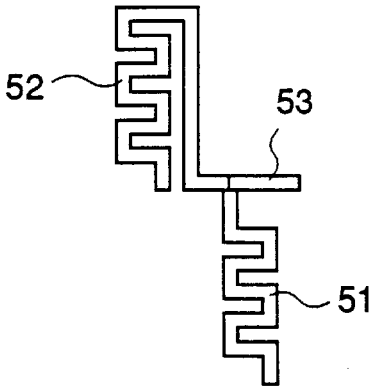
FIG. 6 is a plan view illustrating a T-junction circuit included in a microwave integrated circuit according to a second embodiment of the invention.

FIG. 6 is a diagram illustrating a layout pattern of a T-junction circuit included in a microwave integrated circuit according to a second embodiment of the invention.

In this second embodiment of the invention, in a microwave integrated circuit similar to that described for the first embodiment, portions of a T-junction circuit are made of meandered distributed constant lines. More specifically, the T-junction circuit shown in FIG. 6 comprises a straight line 53, a meander line 51, and a U-shaped line 52 in which one of parallel portions of the U shape is meandered, which lines are connected with each other.

In this second embodiment of the invention, each of the meander lines has a line having at least one U-shaped portion. This meander line construction is common to all embodiments of the present invention.

A description is given of influences of close arrangement of lines on the characteristics of the circuit.

Figure 7:
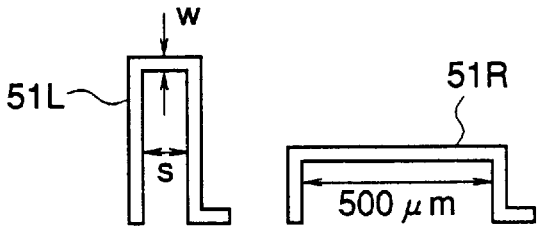
FIGS. 7(*a*)–7(*c*) are plan views illustrating line patterns used for influences of close arrangement of straight lines and meander lines on circuit characteristics.
Figure 7:
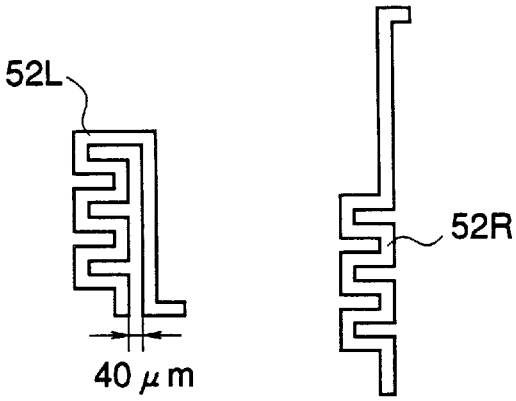
Figure 7:
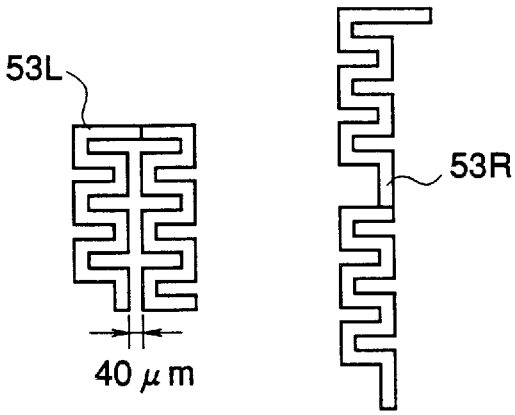

FIGS. 7(*a*)–7(*c*) show line patterns of simulated lines. In these figures, W denotes a line width, and S denotes a space between lines. A line pattern 51L on the left side of FIG. 7(*a*) is formed by bending a straight line into a U shape. This U-shaped line pattern 51L is provided for the purpose of obtaining an effective line length when the space S between the parallel portions of the U-shaped line is changed. A line pattern 52L on the left side of FIG. 7(*b*) is formed by bending a straight line into a U shape and meandering one of parallel portions of the U-shaped line. Further, a line 53L on the left side of FIG. 7(*c*) is formed by bending a straight line into a U shape and meandering parallel portions of the U-shaped line. Each of the line patterns 52L and 53L is provided for the purpose of obtaining an effective line length when the space between the parallel portions is 40 μm.

In FIGS. 7(*a*), 7(*b*), and 7(*c*), line patterns 51R, 52R, and 53R on the right side serve as references when the effective line lengths of the line patterns 51L, 52L, and 53L on the left side are obtained by simulation using EM analysis.

Figure 8:
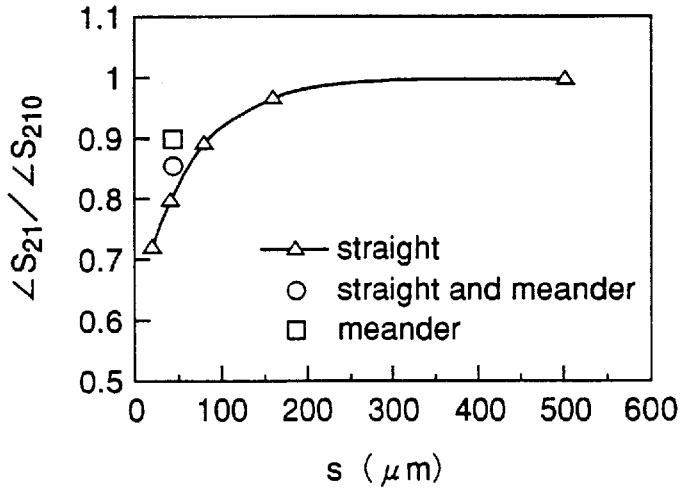
FIGS. 8(*a*) and 8(*b*) are graphs illustrating results of the analysis.
Figure 8:
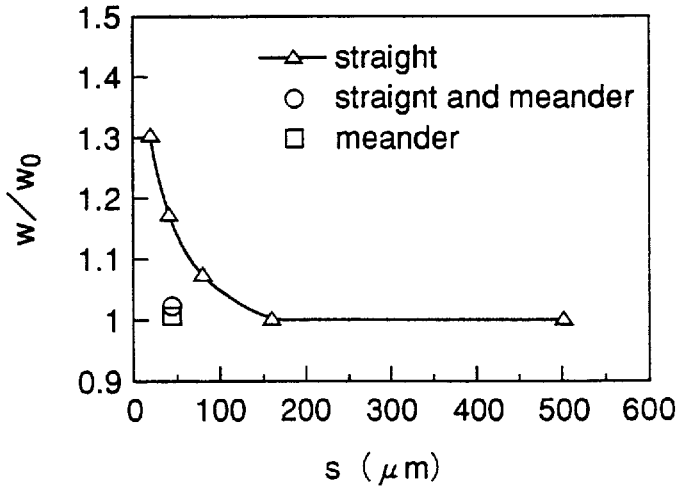

FIGS. 8(*a*) and 8(*b*) are graphs showing results of the EM analysis relating to influences of close arrangement of the respective line patterns shown in FIGS. 7(*a*), 7(*b*), and 7(*c*).

FIG. 8(*a*) is a graph showing effective line lengths obtained by simulation. In FIG. 8(*a*), the abscissa shows the space S (μm) between the parallel portions of the bent (U-shaped) line, and the ordinate shows the ratio of the passing phase $<S_{21}$ of each line with the space S (lines 51L, 52L, and 53L in FIG. 7) to the passing phase $<S_{210}$ of each line ignoring influences due to close arrangement of lines (lines 51R, 52R, and 53R in FIG. 7), that is, the ordinate shows $<S_{21}/<S_{210}$. From FIG. 8(*a*), it is found that the passing phase ratio $<S_{21}/<S_{210}$ of the U-shaped line 51L with straight parallel portions shown in FIG. 7(*a*) (Δ in the graph) decreases and the effective line length decreases with a reduction in the space S. In addition, when the space S is 40 μm, the passing phase ratio of the line 51L becomes about 0.8. For the U-shaped line 52L with a straight portion and a meander portion shown in FIG. 7(*b*) (○ in the graph), the passing phase ratio of this line 52L becomes about 0.86 when the space S is 40 μm. Further, for the U-shaped line 53L with parallel meander portions shown in FIG. 7(*c*) (□ in the graph), the passing phase ratio of this line 53L becomes about 0.9 when the space S is 40 μm. Consequently, influences of close arrangement of lines on the effective line length are smaller in the U-shaped line 52L or 53L in which one or both of the parallel portions is/are meandered than in the U-shaped line 51L in which both the parallel portions are straight.

FIG. 8(*b*) is a graph showing effective line widths obtained by simulation. In the graph, the abscissa shows the space S between parallel portions of the bent (U-shaped) line, and the ordinate shows the ratio of the effective width W of each line with the space S (lines 51L, 52L, and 53L in FIG. 7) to the width $W_0$ of each line ignoring influences due to close arrangement of lines (lines 51R, 52R, and 53R in FIG. 7), that is, the ordinate shows $W/W_0$. From FIG. 8(*b*), it is found that the line width ratio $W/W_0$ of the U-shaped line 51L with straight parallel portions shown in FIG. 7(*a*) (Δ in the graph) increases and the effective line width increases with a reduction in the space S. When the space S is 40 $\mu$m, the line width ratio $W/W_0$ of the line 51L becomes about 0.8, which indicates that the effective line width increases by about 16%. On the other hand, for the U-shaped line 52L (○ in the graph) or 53L (□ in the graph) in which one or both of the parallel portions is/are meandered, the line width ratio $W/W_0$ is about 1 when the space S is 40 $\mu$m, which indicates that the effective line width is not changed.

From the results of the simulation, it is found that, when one or both of two adjacent lines is/are meandered, unwanted influence of close arrangement of lines on the effective line length can be decreased and the influence on the effective line width can be decreased to a negligible level.

A description is given of influences of close arrangement of lines.

Figure 9:
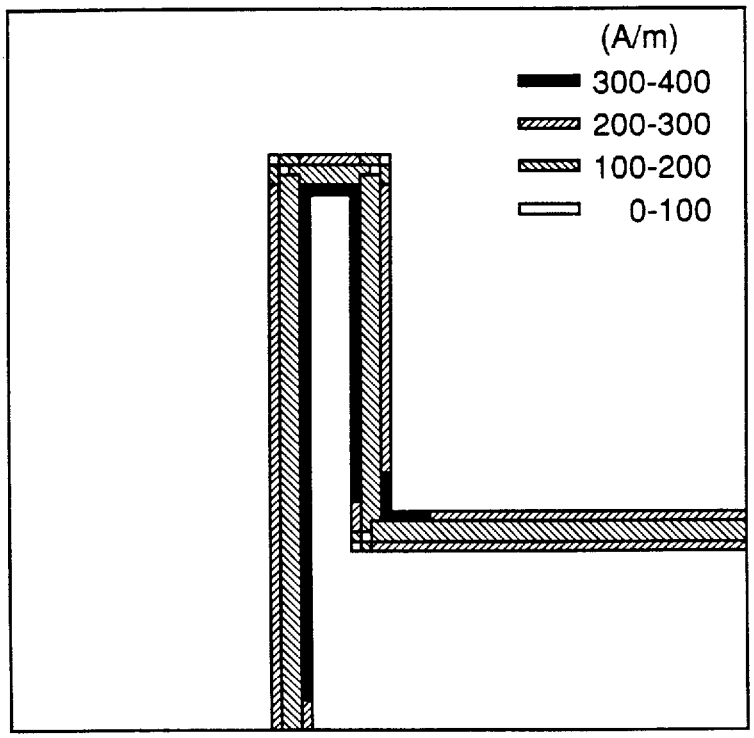
FIGS. 9(*a*) and 9(*b*) are diagrams illustrating current density distributions in a U-shaped line with straight parallel portions and a U-shaped line in which one of parallel portions is meandered, respectively.
Figure 9:
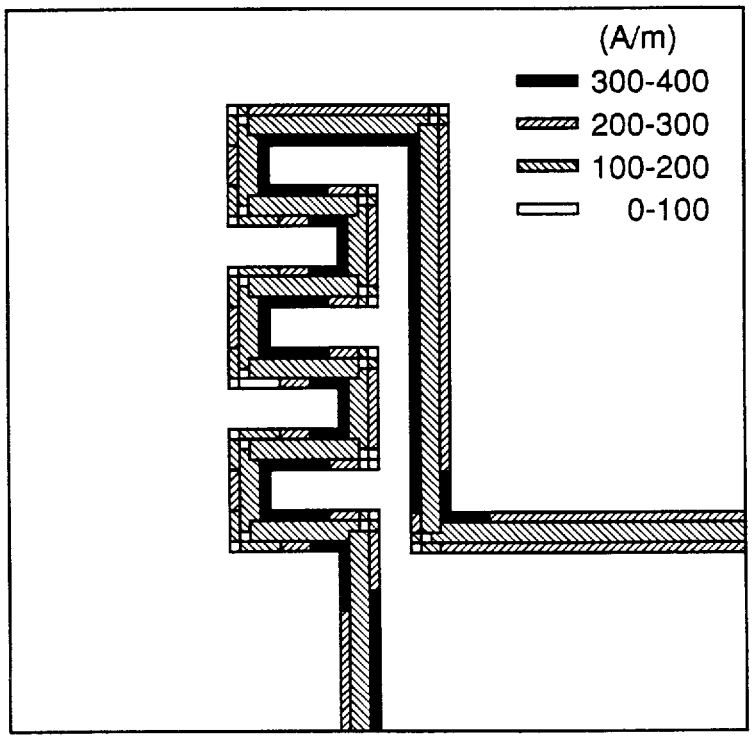

FIGS. 9(*a*) and 9(*b*) show current density distributions in U-shaped lines. In the figures, black regions have the highest current density. FIG. 9(*a*) shows a current density distribution in a U-shaped line with parallel straight portions. Although a current flowing through a straight line usually concentrates on both sides of the line, a current flowing through the U-shaped line shown in FIG. 9(*a*) concentrates on an inner side of the U shape, that is, the current concentrates on facing sides of two parallel portions of the U-shaped line. Such a proximity of high current density portions adversely affects the circuit characteristics.

FIG. 9(*b*) shows a current density distribution in a U-shaped line in which one of two parallel portions is meandered. In the line shown in FIG. 9(*b*), the current density in the meander portion concentrates on an inner side of each bent portion, i.e., each U-shaped portion. In this case, since the highest current density portions are not close to each other compared with the U-shaped line shown in FIG. 9(*a*), unwanted influences on the circuit characteristics are suppressed.

As a result, the use of meander lines in an actual layout provides the following advantages.

(1) Isolation between regions into which a whole circuit is divided for EM analysis is improved. So, the design precision is improved, and line patterns can be closely arranged while maintaining precision.

(2) Within each region for EM analysis, the line length is the only parameter, so that the design time is reduced and line patterns can be closely arranged.

Consequently, in the microwave integrated circuit according to the second embodiment of the invention, since a meandered distributed constant line is used in a portion of a T-junction circuit, miniaturization of the circuit is realized with reduced design time and improved design precision.

Although a portion of a T-junction circuit comprises a meandered distributed constant line in this second embodiment of the invention, the whole T-junction circuit may comprise meandered distributed constant lines with the same effects as mentioned above.

[Embodiment 3]

Figure 10:
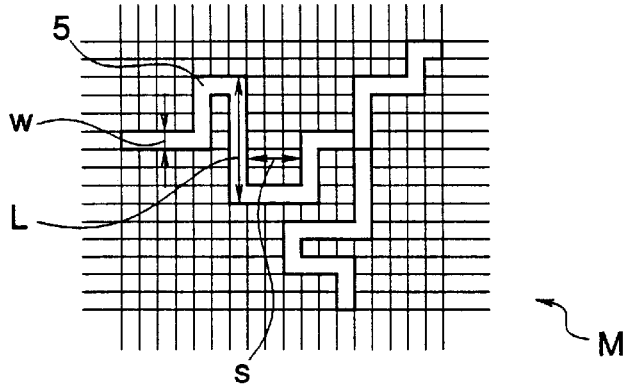
FIG. 10 is a diagram illustrating a layout of a T-junction circuit included in a microwave integrated circuit according to a third embodiment of the invention.

FIG. 10 is a diagram illustrating a layout of a T-junction circuit as a constituent of a microwave integrated circuit according to a third embodiment of the invention.

In this third embodiment, in the microwave integrated circuit according to the first embodiment of the invention, the distributed constant line 5 as a constituent of the T-junction circuit has a length L, a width W, and a space S between adjacent portions of the line, which are set at integer multiples of the minimum line width of the distributed constant line. In FIG. 10, intersecting points of vertical lines and horizontal lines, which are arranged at equal spaces, serve as a grid in line layout and serve as a mesh M in EM analysis. For the EM analysis, mesh gauge must be selected so that all the outlines of the line patterns 5 are placed on, i.e., aligned with, lines of the grid. That is, when the line length L, the line width W, and the line space S are different from each other as shown in FIG. 10, a fine mesh is required.

So, in order to reduce the time required for the EM analysis, it is necessary to lay out the lines 5 so that the outlines of the lines 5 are placed on lines of a coarse grid. On the other hand, highly precise EM analysis is realized by a fine mesh, but a fine mesh increases the analysis time. However, since analysis precision is a matter of importance to the analyst, it is necessary to select an optimum mesh size for the analysis time and precision in the EM analysis considering the precision desired.

In the microwave integrated circuit according to the third embodiment of the invention, since the length L, the width W, and the space S of the distributed constant line 5 as a constituent of the T-junction circuit are set at integer multiples of the minimum line width of the distributed constant line 5, mesh size in EM analysis can be selected as the minimum line width, whereby the analysis time is reduced and the analysis precision is improved.

[Embodiment 4]

Figure 11:
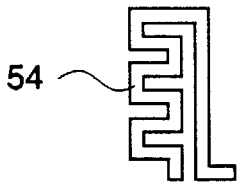
FIG. 11 is a plan view illustrating a distributed constant line included in a microwave integrated circuit according to a fourth embodiment of the invention.

FIG. 11 is a plan view illustrating a distributed constant line 54 employed in a microwave integrated circuit according to a fourth embodiment of the invention. A microwave integrated circuit according to this fourth embodiment is provided with a matching circuit comprising a line 54 which is obtained by bending a single distributed constant line into a U shape and meandering one of two parallel portions of the U-shaped line.

In the line 54 shown in FIG. 11, since the density of current flowing through the meandered portion concentrates on the inner side of each U-shaped portion as described with respect to FIG. 9(*b*), unwanted influences of the close arrangement of lines on the circuit characteristics are reduced, so that a layout in which lines are closely arranged can be employed in a design. As a result, a miniaturized microwave integrated circuit is realized.

[Embodiment 5]

Figure 12:
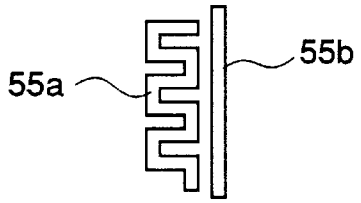
FIG. 12 is a plan view illustrating a distributed constant line included in a microwave integrated circuit according to a fifth embodiment of the invention.

FIG. 12 is a plan view illustrating distributed constant lines 55*a* and 55*b* employed in a microwave integrated circuit according to a fifth embodiment of the invention. A microwave integrated circuit according to this fifth embodiment is provided with a matching circuit comprising a meander line 55*a* and a straight line 55*b* which are closely arranged in parallel.

In FIG. 12, since the density of current flowing through the meander line 55*a* concentrates on the inner side of each U-shaped portion as described with respect to FIG. 9(*b*), unwanted influences of the close arrangement of lines on the circuit characteristics are reduced, so that a layout in which lines are closely arranged can be employed in design. As a result, a miniaturized microwave integrated circuit is realized.

[Embodiment 6]

Figure 13:
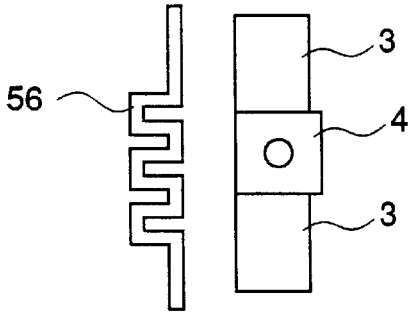
FIG. 13 is a plan view illustrating a distributed constant line included in a microwave integrated circuit according to a sixth embodiment of the invention.

FIG. 13 is a plan view illustrating a distributed constant line 56 employed in a microwave integrated circuit according to a sixth embodiment of the invention. In a microwave integrated circuit according to this sixth embodiment, a matching circuit comprising a meander line 56 is placed in the vicinity of elements on the integrated circuit, such as MIM capacitors 3 and a via-hole 4 as shown in FIG. 13.

In the line 56 shown in FIG. 13, since the density of current flowing through the meander line 56 concentrates on the inner side of each U-shaped portion as described with respect to FIG. 9(*b*), unwanted influences of the close arrangement of lines on the circuit characteristics are reduced, so that a layout in which lines are closely arranged can be employed in a design. As a result, a miniaturized microwave integrated circuit is realized.

[Embodiment 7]

Figure 14:
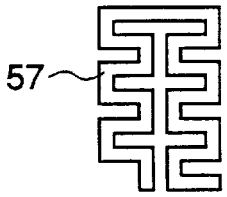
FIG. 14 is a plan view illustrating a distributed constant line included in a microwave integrated circuit according to a seventh embodiment of the invention.

FIG. 14 is a plan view illustrating a distributed constant line 57 employed in a microwave integrated circuit according to a seventh embodiment of the invention. A microwave integrated circuit according to this seventh embodiment is provided with a matching circuit comprising a line 57 which is obtained by bending a single distributed constant line into a U shape and meandering two parallel portions of the U-shaped line.

In the line 57 shown in FIG. 14, since the density of current flowing through the meandered portions concentrates on the inner side of each U-shaped portion as described with respect to FIG. 9(*b*), unwanted influences of the close arrangement of lines on the circuit characteristics are reduced, so that a layout in which lines are closely arranged can be employed in a design. As a result, a miniaturized microwave integrated circuit is realized.

[Embodiment 8]

Figure 15:
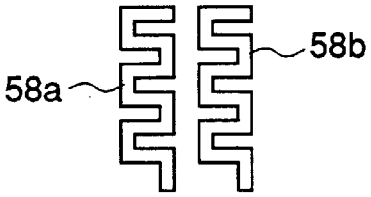
FIG. 15 is a plan view illustrating a distributed constant line included in a microwave integrated circuit according to an eighth embodiment of the invention.

FIG. 15 is a plan view illustrating distributed constant lines 58*a* and 58*b* employed in a microwave integrated circuit according to an eighth embodiment of the invention. A microwave integrated circuit according to this eighth embodiment is provided with a matching circuit comprising two meander lines 58*a* and 58*b* which are closely arranged in parallel.

In FIG. 15, since the density of current flowing through the meander lines 58*a* and 58*b* concentrates on the inner side of each U-shaped portion as described with respect to FIG. 9(*b*), unwanted influences of the close arrangement of lines on the circuit characteristics are reduced, so that a layout in which lines are closely arranged can be employed in a design. As a result, a miniaturized microwave integrated circuit is realized.

What is claimed is:

1. A method for designing a microwave integrated circuit to reduce electromagnetic interactions between circuit elements, the method including:

designing initially a microwave integrated circuit including active elements and a matching circuit, the matching circuit connecting the active elements and consisting of distributed constant transmission lines;

laying out the active elements and matching circuit of the initially designed microwave integrated circuit on a circuit substrate; and analyzing electromagnetic performance of the initially designed and laid out microwave integrated circuit, including analyzing electromagnetic performance of respective distributed constant transmission lines of the matching circuit of the initially designed and laid out microwave integrated circuit, comparing the electromagnetic performance of the microwave integrated circuit with a desired electromagnetic performance of the microwave integrated circuit, and altering layout of the microwave integrated circuit so that the microwave integrated circuit has the desired electromagnetic performance, wherein the matching circuit consists of a plurality of T-junction circuits, each T-junction circuit having three distributed constant transmission lines with respective widths and lengths, the widths and lengths being adjustable parameters for altering the layout.

2. The method of designing a microwave integrated circuit as defined in claim 1 wherein the microwave integrated circuit includes a plurality of matching circuits, each matching circuit including up to two distributed constant transmission lines as a unit in a T-junction circuit, the widths and lengths of missing distributed constant transmission lines of a T-junction circuit being taken as zero.

3. The method of designing a microwave integrated circuit as defined in claim 1 including laying out at least one of three distributed constant transmission lines of the T-junction circuit as a meandering transmission line.

4. The method of designing a microwave integrated circuit as defined in claim 1 including laying out three meandering distributed constant transmission lines as the T-junction circuit.

5. The method of designing a microwave integrated circuit as defined in claim 1 including laying out meandering distributed constant transmission lines proximate one of the active elements.

6. The method of designing a microwave integrated circuit as defined in claim 1 including laying out with widths and lengths and spacing between adjacent distributed constant transmission lines, of a T-junction circuit as integer multiples of a minimum width of the distributed constant transmission line.

7. The method of designing a microwave integrated circuit as defined in claim 1 including laying out at least one of two parallel distributed constant transmission lines adjacent to each other in a matching circuit as a meandering transmission line.

8. The method of designing a microwave integrated circuit as defined in claim 7 wherein the two distributed constant transmission lines adjacent and parallel to each other are U-shaped.

9. The method of designing a microwave integrated circuit as defined in claim 7 wherein the two distributed constant transmission lines are close to each other.

10. A method for designing a microwave integrated circuit to reduce electromagnetic interactions between circuit elements, the method including:

designing initially a microwave integrated circuit including active elements and a matching circuit, the matching circuit connecting the active elements and consisting of distributed constant transmission lines;

laying out the active elements and matching circuit of the initially designed microwave integrated circuit on a circuit substrate; and analyzing electromagnetic performance of the initially designed and laid out microwave integrated circuit, including analyzing electromagnetic performance of respective distributed constant transmission lines of the matching circuit of the initially designed and laid out microwave integrated circuit, comparing the electromagnetic performance of the microwave integrated circuit with a desired electromagnetic performance of the microwave integrated circuit, and altering layout of the microwave integrated circuit so that the microwave integrated circuit has the desired electromagnetic performance, wherein the matching circuit consists of a plurality of T-junction circuits, each T-junction circuit having three distributed constant transmission lines with respective widths and lengths, the widths and lengths being adjustable parameters for altering the layout, the layout optimization presuming an initial effective line width and line length and, the method including, subsequently determining a final effective line length to realize the desired electromagnetic performance.

* * * * *